United States Patent [19]

Williams

[11] 4,267,964

[45] May 19, 1981

[54] CENTRIFUGAL SEPARATOR WITH ROTATING PICK-UP TUBE

[75] Inventor: Carter P. Williams, Yosemite, Calif.

[73] Assignee: Kobe, Inc., Huntington Park, Calif.

[21] Appl. No.: 80,420

[22] Filed: Oct. 1, 1979

[51] Int. Cl.[3] ..... B04B 11/08; F04D 1/14

[52] U.S. Cl. ..... 233/21; 233/10; 415/88; 415/89

[58] Field of Search ..... 233/19 R, 19 A, 10, 233/21, 22, 16, 28, 27, 7; 415/88, 89

[56] References Cited

U.S. PATENT DOCUMENTS

| | | | |
|---|---|---|---|
| 3,776,658 | 12/1973 | Erickson | 415/88 |
| 3,795,459 | 3/1974 | Erickson | 415/89 |
| 3,838,939 | 10/1974 | Erickson | 415/89 |
| 3,926,534 | 12/1975 | Erickson | 415/88 |
| 3,960,319 | 6/1976 | Brown | 233/19 R |
| 3,994,618 | 11/1976 | Erickson | 415/89 |
| 4,036,427 | 7/1977 | Erickson | 415/89 |

*Primary Examiner*—Robert W. Jenkins

*Attorney, Agent, or Firm*—Christie, Parker & Hale

[57] ABSTRACT

A centrifugal separator and pitot pump has a rotatable hollow casing for separating contaminants such as suspended solids from an inlet fluid delivered to the interior of the casing. Inside the casing a stationary inner pitot tube has an outlet opening relatively nearer the rotational axis of the casing, and a separate rotatable outer pitot tube has an outlet opening relatively nearer the periphery of the casing. The outer pitot tube is rotated in the same direction of rotation as the casing, but at a slower speed, and the rotating casing forces separated solids outwardly toward the periphery of the casing where the solids are withdrawn in a fluid carrier through the outer pitot tube. Rotation of the outer pitot tube greatly reduces particle erosion of the tube caused by impingement of abrasive solid particulate material when compared with erosion produced on a fixed pitot tube. Clean fluid is withdrawn from an intermediate region of the casing through the stationary inner pitot tube. Separated solids and clean fluid are separately discharged from the casing.

10 Claims, 2 Drawing Figures

CENTRIFUGAL SEPARATOR WITH ROTATING PICK-UP TUBE

BACKGROUND

This invention relates to centrifugal separators for fluids, and more particularly, to centrifugal pumps of the pitot type having an improved pitot pickup that is particularly resistant to particle erosion.

Centrifugal pumps of the pitot type are well known. Known pitot pumps include those described in the following U.S. Pat. Nos. 3,384,024; 3,776,658; 3,795,459; 3,817,659; 3,838,939; 3,926,534; 3,960,319; 3,977,810; 3,994,618; and 4,036,427. In general, pitot pumps include a drive that drives a hollow casing in rotation within a surrounding fixed housing. A pitot pickup tube in the rotary casing is stationary relative to the casing and intercepts fluid within the casing and draws that fluid from the casing. The exiting fluid has a head larger than its inlet fluid head because of the energy imparted to it by the rotating casing.

Pitot pumps are used for many purposes. One use which illustrates the problem that the present pitot pump solves is to supply motive pressurized fluid to a hydraulic pump located in the bore of an oil well for pumping oil out of the well into a suitable collection facility. In such an application, the motive fluid for the well bore pump can be a portion of the oil produced from the well itself and supplied to the inlet of the pitot pump. Very often, however, the oil taken from the well contains contaminants, such as sand, which should be removed from the oil before the oil is returned under pressure to the pump located in the well. The presence of abrasive solid contaminants such as sand in pressurized oil supplied to the well bore pump can produce undue wear and damage to the pump. For example, solid abrasives can erode journals and journal bearings and destroy seals of such a pump.

Centrifugal pitot pumps, usually in conjunction with other separating equipment, have been used to remove solids from power fluid streams and to separate well fluid into its phases. The pitot tube separator can take power fluid, say oil, from the separator and remove solids from the stream. A pitot tube in the path of the rotating inlet fluid can be subjected to the errosive effect of solids in the fluid. This errosive effect is directly proportional to the cube of the relative velocity between the fluid and the pitot tube. In a casing having a comparatively large radius, in which solids are forced to the periphery of the rotating casing, the separated solids travel at high speeds and the errosive effect caused by impingement of the solids on the pitot pickup can greatly reduce the useful life of the pump.

Accordingly, it is desirable to provide a pitot pump for removing abrasives from an inlet fluid while reducing the errosive effect on the pitot tube caused by the abrasive material impinging on it at high speeds.

SUMMARY OF THE INVENTION

Briefly, the present invention, according to one embodiment, provides a centrifugal pitot pump having a casing that is rotatable in a selected direction of rotation, and an inlet to the casing for delivering an inlet fluid to the interior of the casing. A fixed inner pitot tube can have a fluid outlet relatively nearer the axis of rotation of the casing for drawing fluid from the casing into the inner pitot tube. An outer pitot tube has a fluid outlet relatively nearer the periphery of the casing. The outer pitot tube is rotatable in the same direction of rotation as the casing, but at a slower speed, to draw fluid from the casing into the outer pitot tube. By rotating the outer pitot tube, liquid in the rotating casing impinging on the outlet of the moving pitot tube has a lower effective velocity than if the pitot tube were fixed. This lower impingement velocity can greatly reduce erosion of the outer pitot tube by abrasive material being separated and withdrawn from near the periphery of the rotating casing.

DRAWINGS

These and other aspects of the invention will be more fully understood by referring to the following detailed description and the accompanying drawings, in which:

FIG. 1 is a fragmentary, side elevation view, partly in cross-section and partly broken away, showing a pitot pump and separator having an improved pitot pickup according to principles of this invention; and FIG. 2 is a cross-sectional view taken on line 2—2 of FIG. 1.

DETAILED DESCRIPTION

Figure 1:
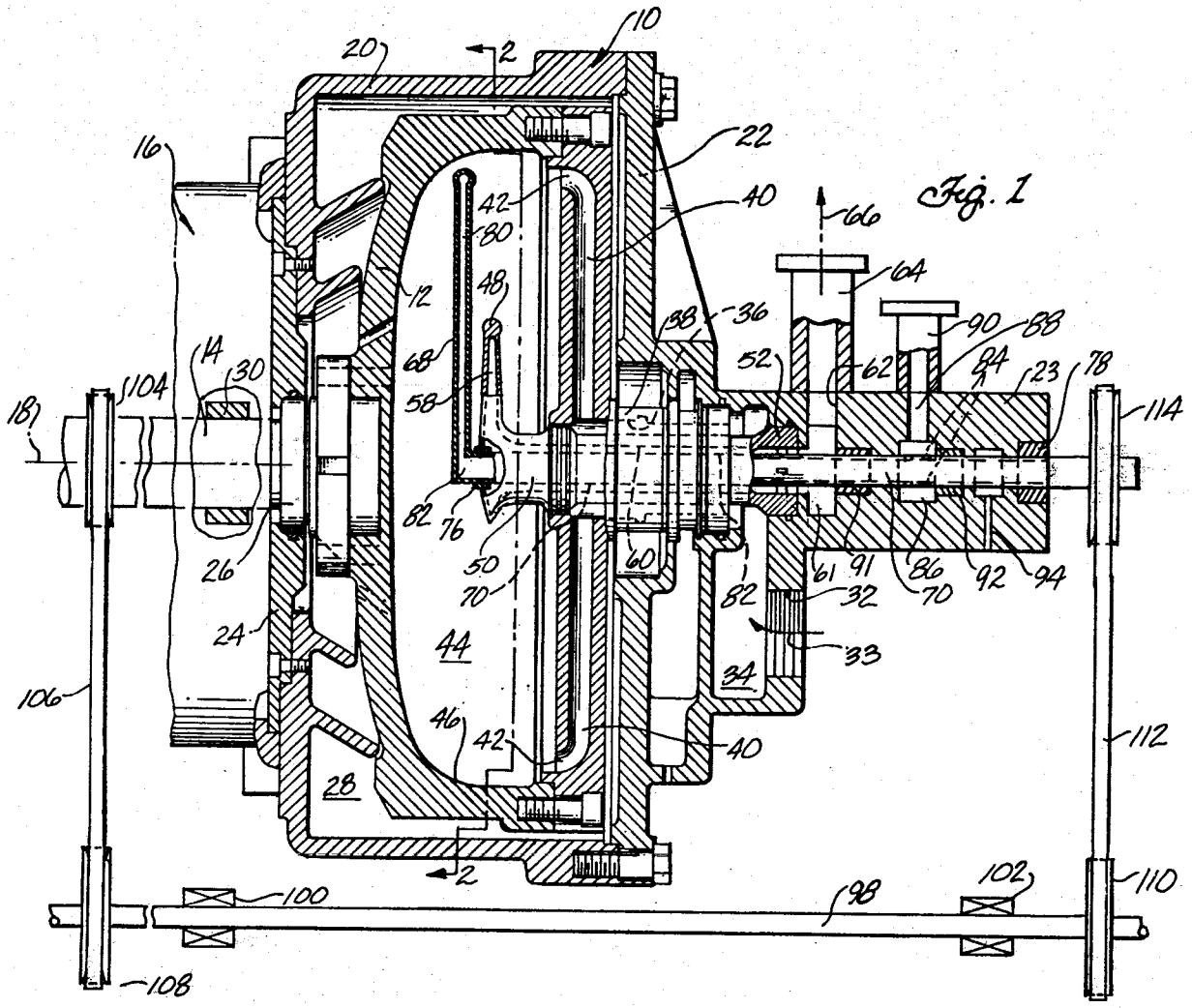

Referring to the drawings, a centrifugal pitot type pump and separator includes a stationary outer housing 10 and a hollow rotary casing 12 inside the housing. The casing is mounted to a drive shaft 14 of a prime mover such as an electric motor (not shown) in a motor support and bearing assembly 16. The motor drives the shaft to rotate the casing about an axis 18 of symmetry of the casing. The housing principally comprises an annular casting 20 open at an end opposite the drive motor where the annular casting is closed by a cover 22 that includes an axial extension 23. A smaller cover plate 24 closes an opening at the other end of the casting adjacent the motor. The cover plate 24 mounts a seal 26 that cooperates with the drive shaft 16 to prevent leakage of fluid from a housing chamber 28 along the drive shaft into the motor and bearing support assembly 16. The drive shaft is supported within the motor and bearing support assembly 16 by bearings 30 (only one is shown schematically in FIG. 1) so that the shaft carries the rotary casing 12 in a cantilever fashion within the housing chamber.

Fluid to be pumped and cleaned enters the pump through an inlet port 32 formed in the cover 22. The inlet fluid flows in the direction of the arrow 33 and passes into an antechamber 34. From this chamber the fluid passes along an annular inlet passage 36 formed coaxially through an axial inlet hub 38 of the rotary casing. A plurality of ducts 40 formed within the end wall of the casing extend radially outwardly from the axis of the casing. These ducts receive inlet fluid from the annular inlet passage 36 and empty the fluid into outlet passages 42 at their outer radial ends to empty the fluid into a hollow interior chamber 44 within the casing 12. The outlet openings 42 are located relatively closely adjacent to a periphery 46 of the casing interior. The ducts 40 thus provide fluid flow communication between the annular inlet passage 36 and the interior chamber 44 of the casing.

Rotation of the casing carries the inlet fluid in the chamber 44 along with it. A first pitot tube or pickup tube 48 within the casing chamber extends radially, i.e., generally perpendicularly, away from the rotational axis of the casing. The first pitot tube is mounted in a stationary or fixed position inside the rotary casing. The inner end of the first pitot tube is formed at the end of a fixed sleeve 50 that extends coaxially through the pump housing and into the interior of the casing. The annular inlet passage 36 for flow of inlet fluid surrounds the pitot tube sleeve 50. A hub 52 of the pitot tube sleeve is supported in the housing cover 22 in a stationary manner for permitting the casing to rotate relative to the fixed pitot tube 48 and its fixed sleeve 50. The stationary pitot tube 48 includes a pickup 54 with an outlet opening 56 (see FIG. 2) facing in a direction opposite to the direction of rotation of the rotary casing. The outlet of the stationary pitot tube faces fluid rotating in the casing chamber 44 and impinging on the outlet for withdrawing this fluid from the chamber. Fluid passing into the outlet opening of the stationary pitot tube then passes through a radial passage 58 in the leg of the pitot tube and then passes along an annular discharge passage 60 within the sleeve 50. The annular discharge passage of the fixed pitot tube extends coaxially with respect to the casing axis of rotation. The discharge passage communicates with a first annular discharge chamber 61 and a first discharge port 62 in the extension 23 of the cover 22. The discharge port leads into a collection fitting 64 for receiving clean fluid pumped from the housing through the discharge port 62.

Thus, fluid to be cleaned can enter the inlet port 32 of the housing and pass into the interior of the casing, rotation of the casing relative to the stationary pitot tube 48 can cause clean fluid to be extracted from the casing by the outlet of the stationary tube, and the cleaned fluid can exit the casing through discharge passage 60 in a counterflow manner coaxial of the casing. The clean fluid is then discharged from the pump through the discharge passage 62 in the direction of the arrow 66 indicated in FIG. 1.

A second pitot tube 68 within the casing interior extends radially, i.e., generally perpendicularly, away from the rotational axis of the casing. The second pitot tube is formed at the end of a coaxial drive tube 70 mounted for rotation inside the fixed sleeve 50 that mounts the first pitot tube. The leg of the second pitot tube extends adjacent to and generally parallel to the first pitot tube, terminating at a pickup 72 having an outlet opening 74 (see FIG. 2) adjacent the periphery 46 of the casing interior. As in the first pitot tube, the pickup and outlet of the second pitot tube face in a direction opposite to the direction of rotation of the casing.

A bearing 76 mounts the drive tube for rotation with respect to the stationary pitot tube inside the casing. A bearing 78 mounts the opposite end of the drive tube for rotation in the extension 23 of the housing.

The first pitot tube can be about one-half to two-thirds the length of the second pitot tube, and thus outlet of the first pitot tube is located at an intermediate region of the casing between the rotational axis of the casing and the periphery of the casing. Thus, the first pitot tube can be referred to as an inner pitot tube, and the second pitot tube can be referred to as an outer pitot tube. The outlet of the outer pitot tube intercepts particulate solid material accumulating in fluid forced to the outer radial periphery of the rotating casing. The outlet of the outer pitot tube withdraws particulate solids and their fluid carrier from the periphery of the casing into a radial passage 80 extending through the leg of the tube. The separated particulate solids and fluid then pass from the outer pitot tube along a coaxial passage 82 in the rotary drive tube 70. The particulate solids and fluid then pass from the rotary drive tube through radial perforations 84 in the tube, passing into a second annular discharge chamber 86 within the housing cover 22. The solids and fluid then exit the pump through a second radial discharge passage 88 communicating with the second annular discharge chamber 86. An outlet fitting 90 receives separated solid material and its fluid carrier from the discharge passage 88.

A first rotary seal 91 adjacent the outer end of the first annular discharge chamber 61 seals against fluid passing along the outer surface of the rotary drive tube 70 past the first discharge chamber. Similarly, a second rotary seal 92 adjacent the outer end of the second discharge chamber 86 seals against fluid passing along the drive tube past the second discharge chamber. A small diameter passage 94 adjacent the seal 92 bleeds to the atmosphere.

Figure 2:
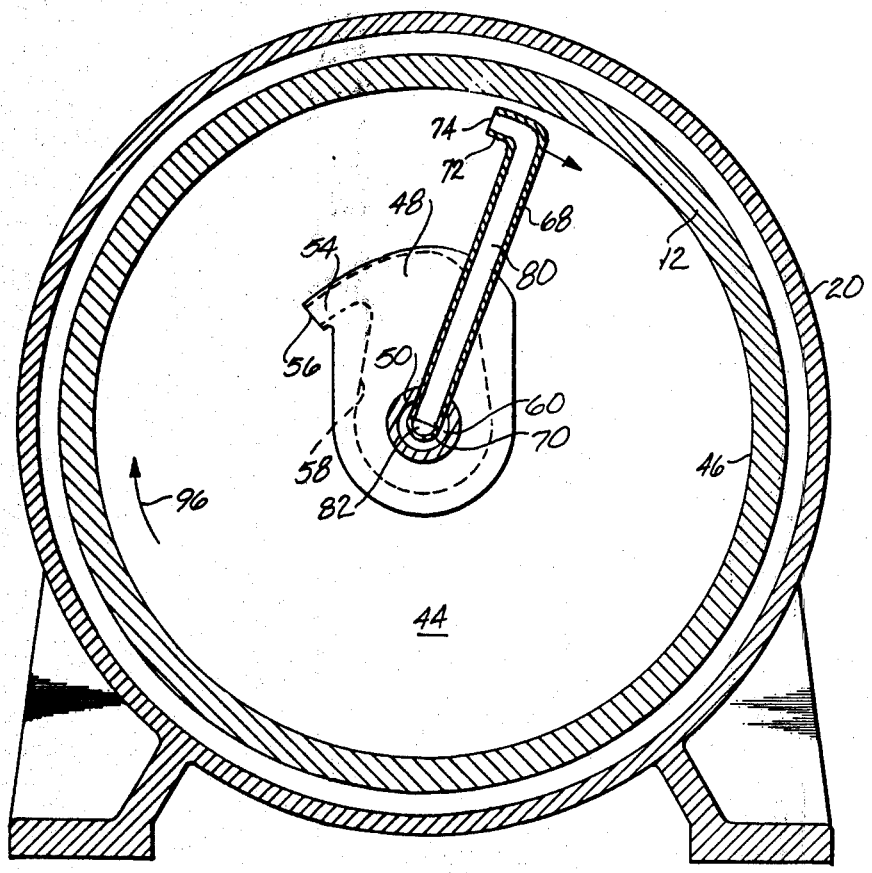

Generally, then, as the casing 12 is rotated at high speed in a predetermined direction, say for example in the direction of the arrow 96 in FIG. 2, the casing ducts 40 function as a centrifugal pump to draw fluid to be pumped and cleaned into the inlet port 32. The head of the moving fluid increases in the casing ducts 40 and the fluid is discharged at high velocity into the casing chamber adjacent the periphery 46 of the casing. Within the chamber the fluid rotates and increases in head and stratifies according to its density, with the densest material being radially outward of the less dense material. Particulate solids, being the densest of material, are forced toward the peripheral wall of the rotary casing where they are picked up in a fluid carrier by the outer pitot tube and withdrawn from the chamber. Relatively clean solid-free fluid is withdrawn from the chamber through the inner pitot tube. The inner pitot tube, having its inlet at an intermediate region in the casing, collects pumped fluid from which a major portion, if not all, of the contaminant has been removed. The precise radial position of the inner pitot tube outlet is selected with regard to the pressure to be produced by the pump and the amount and extent of contaminant which is tolerable in the pump discharge. The pressure of the fluid entering each pitot tube is increased by the ram effect which converts the velocity head of such fluid into pressure due to the configuration of the pitot passage in each pitot tube. Relatively clean fluid picked up by the inner pitot tube is thus discharged from the housing under pressure through the discharge port 62, and concentrated fluid containing particulate solid material picked up by the outer pitot tube is discharged from the housing under reduced pressure through discharge port 88.

Particulate solid material intercepting the outlet end of the outer pitot tube can cause the end of the tube to erode. The erosion intensity of solids on any object struck by the solids is generally proportional to the cube of the velocity of the solid material with respect to the imparted object. Since the velocity of the fluid within the casing chamber increases with an increase in the radius, the errosive force of the solids suspended in the fluid increases generally as the cube of the radius of the casing chamber. This produces a large potential errosive effect on an outer pitot tube at the periphery of the casing. The present invention provides an improvement in the resistance of pitot tube pickups to this type of errosion. To inhibit such errosion, the outer pitot tube 68 is rotated in the same direction is the casing 12, but at a slower angular velocity or speed. Because the tip of the outer pitot tube is constantly being rotated in the same direction of rotation as the impinging fluid at the periphery of the casing, the fluid impinging on the open mouth of the moving pitot tube has a lower effective velocity than a fixed pitot tube intercepting such rotating fluid at the periphery of the casing. Since the moving pitot tube is rotated with a differential velocity with respect to the casing, the velocity of the moving pitot tube being less than that of the casing, an impingement force of the rotating fluid on the mouth of the outer pitot tube is produced. However, the impingement force can be greatly reduced, compared with a fixed pitot tube, by rotating the pitot tube at a speed relatively near the speed at which the casing is rotated. In one embodiment the outer pitot tube is rotated at a speed in the range of 80% to 90% of the speed of the casing. This greatly reduces the impingement force at the tip of the moving pitot tube. By substantially reducing the impingement velocity, the errosion intensity at the tip of the pitot tube is greatly reduced since errosion intensity is proportional to the cube of the impingement velocity.

The reduced impingement force also produces a pressure of moving fluid in the moving pitot tube that is less than the pressure in a fixed pitot tube; but the speed differential between the moving pitot tube and the casing can be sufficient to produce a fluid pressure in the moving pitot tube that will still continue to effectively remove liquid and separated particulate solids from the rotating casing, although the pressure of the discharged fluid is lower than that of the clean fluid discharged up by the fixed inner pitot tube.

Experimental tests have been made with a pitot tube for separating particulate solids in a separator similar to that shown in the drawings. In one instance, the pitot tube was held in a fixed position and an appreciable amount of errosion of such a pitot tube was encountered in a rather short operating time. In a test conducted with a similar pitot tube that was rotated in the same direction as the casing, but at a slower speed, significantly reduced wear was observed.

The moving pitot tube can be driven by a variety of drive means. An example of such a drive means is illustrated in FIG. 1, in which a mechanical drive linked with the drive of the casing rotates the outer pitot tube at a fixed percentage of the casing rotation. Such a drive mechanism can include a drive shaft 98 extending along the exterior of the casing parallel to the rotational axis of the casing. Bearings shown schematically at 100 and 102 are mounted near opposite ends of the drive shaft 98 to mount the drive shaft for rotation. A belt drive with suitable gear reduction can rotate the drive tube 70 at a speed less than the casing speed, although a chain drive or other similar means for driving the drive tube 70 at a lower speed can be used. In the illustrated belt drive, a drive pulley 104 on the drive shaft 14 of the casing transfers rotational speed of the casing drive shaft to the external drive shaft 98 through a belt 106 engaged with a driven pulley 108 on the external drive shaft. The pulleys 104 and 108 can be the same diameter so that the rotational speed of the casing drive shaft can be directly transferred to the external drive shaft. At the opposite end of the external drive shaft, a pulley 110 is engaged with a second drive belt 112 which, in turn, is engaged with a larger diameter pulley 114 at the end of the pitot tube drive tube 70. This arrangement results in the drive tube 70 being rotated at an angular velocity less than that of the casing, so that the outer pitot tube is rotated in the same direction, but at a lower angular velocity or speed than the casing. By rotating the drive tube at approximately 80% to 90% of the casing speed, sufficient pressure is produced in the moving pitot tube to withdraw separated particulate solids from the casing, while appreciably reducing errosion of the pitot tube pickup. The belt drive shown in the drawings is illustrated for example only, since other means for rotating the outer pitot tube can be used. For example, an internal turbine or hydraulic mechanism can be used for hydraulically driving the drive tube 70 from inside the casing, as opposed to using the illustrated external drive. Further, the pitot drive can be simply modified to adjust the speed differential between the casing and the rotating pitot tube. The is provides means for controlling the amount of reduced pressure in fluid discharged by the moving pitot tube when compared with the high pressure of fluid discharged by the fixed pitot tube.

Thus, contaminated fluid can be delivered to the pumping chamber within the rotary casing, and contaminants such as particulate solids or other abrasive material can be separated from the delivered fluid by centrifugal action within the pumping chamber in response to rotation of the casing. In a presently preferred use of the pump-separator, sand is the contaminant in the principal fluid, oil, and is to be removed in a carrier fluid separately from the cleaned principal fluid, namely oil. The cleaned fluid is removed at a greatly increased pressure with respect to the separated solids and carrier fluid, which are removed at a much lower pressure owing to the reduced fluid pressure in the rotating outer pitot tube. In certain instances it can be desirable to discharge contaminants at such a reduced fluid pressure.

Workers skilled in the art to which this invention pertains will appreciate that the foregoing description has been presented principally by way of illustration and example with reference to presently preferred embodiments of the invention. Such persons also will appreciate that modifications can be made in the structure and procedures described herein without departing from the scope of the invention. For example, the invention can be implemented in a pump for pressurizing incoming fluid in addition to the separator shown in the drawings. Accordingly, the foregoing description should not be considered as limiting the scope of the invention as set forth in the following claims.

What is claimed is:

1. A centrifugal pitot pump having a casing; means for rotating the casing in a selected direction of rotation; means for delivering fluid to the interior of the casing; a stationary inner pitot tube having a fluid outlet relatively nearer the axis of rotation of the casing for withdrawing fluid from an intermediate region of the casing into the inner pitot tube; an outer pitot tube having a fluid outlet relatively nearer the periphery of the casing; and means for rotating the outer pitot tube in the same direction of rotation as the casing, but at a slower speed than the casing to withdraw fluid from a peripheral region of the casing into the outer pitot tube.

2. In a centrifugal separator of the type having a casing rotatable in a selected direction of rotation, and means for delivering to the interior of the casing an inlet fluid with solid material to be separated from the fluid, the improvement comprising;

a stationary inner pitot tube having a fluid outlet relatively nearer the axis of rotation of the casing for withdrawing clean outlet fluid from the casing;

an outer pitot tube having a fluid outlet relatively nearer the periphery of the casing; and means for rotating the outer pitot tube in the same direction of rotation and at a slower speed than the casing for producing sufficient pressure in the outer pitot tube to withdraw fluid and separated solids from near the periphery of the casing.

3. The improvement according to claim 2 including means for separately discharging from the casing the fluid withdrawn by the inner and outer pitot tubes.

4. The improvement according to claim 2 in which the outer pitot tube is on a rotary drive tube that rotates inside a stationary coaxial sleeve that mounts the stationary inner pitot tube.

5. The improvement according to claim 4 including means for separately passing fluid to be discharged to the drive tube and to the stationary sleeve from the outer pitot tube and the inner pitot tube, respectively.

6. A combination pitot pump and centrifugal separator comprising:

drive means for rotating the casing about its axis;

means for delivering to the interior of the casing an inlet fluid with solids to be separated from the fluid;

an inner pitot tube having a fluid outlet relatively nearer the axis of rotation of the casing for withdrawing clean outlet fluid from an intermediate region of the casing;

means mounting the inner pitot tube in a stationary position extending radially outwardly from the casing axis of rotation;

an outer pitot tube having a fluid outlet relatively nearer the periphery of the casing;

means for mounting the outer pitot tube adjacent the inner pitot tube and for rotating the outer pitot tube relative to the inner pitot tube, the outer pitot tube being rotatable about the axis of rotation of the casing; and means for rotating the outer pitot tube in the same direction of rotation as the casing, but at a slower speed than the casing, but at a speed sufficient for the outer pitot tube to withdraw fluid and separated solids from near the periphery of the casing.

7. Apparatus according to claim 6 including gear reduction means between the casing drive means and the means for rotating the outer pitot tube for rotating the outer pitot tube at a speed that is a selected proportion of the casing drive speed.

8. Apparatus according to claim 7 in which the outer pitot tube is rotated at a speed at least about 80% of the casing speed.

9. Apparatus according to claim 6 including means for separately discharging from the casing fluid withdrawn by the inner and outer pitot tubes.

10. In a pitot type pump having a rotatable casing, and inlet means for delivering an inlet fluid to the interior of the casing, improved means for pressurizing the inlet fluid while reducing errosive effects of solids contained in the inlet fluid, comprising:

a pitot tube having a fluid outlet adjacent the periphery of the casing for withdrawing fluid and any separated solids therein from the casing; and means for rotating the outer pitot tube in the same direction of rotation as the casing, but at a speed lower than the rotational speed of the casing, but at a sufficient speed to withdraw fluid and any separated solids from the casing and to reduce erosion of the pitot tube when compared with the erosion produced when the same pitot tube is held in a fixed position in the casing.

* * * * *

UNITED STATES PATENT AND TRADEMARK OFFICE

CERTIFICATE OF CORRECTION

PATENT NO. : 4,267,964

DATED : May 19, 1981

INVENTOR(S) : Carter P. Williams

It is certified that error appears in the above—identified patent and that said Letters Patent is hereby corrected as shown below:

Column 4, line 66, "is" second occurrence should read -- as --. Column 5, lines 63 and 64, "pitot tube drive tube 70" should read -- pitot tube 70 --. Column 6, line 13, "The is provides" should read -- This provides --. Column 8, line 29, Claim 10, "lower" should read -- slower --.

Signed and Sealed this

*Fifteenth* Day of *December 1981*

[SEAL]

*Attest:*

GERALD J. MOSSINGHOFF

*Attesting Officer*

*Commissioner of Patents and Trademarks*